US006443110B2

(12) United States Patent
Qattan

(10) Patent No.: US 6,443,110 B2
(45) Date of Patent: Sep. 3, 2002

(54) ROTARY VALVE HEAD SYSTEM FOR MULTI-CYLINDER INTERNAL COMBUSTION ENGINES

(76) Inventor: Jamal Umar Qattan, 10045 Gaviota Ave., North Hills, CA (US) 91343

( * ) Notice: Subject to any disclaimer, the term of this patent is extended or adjusted under 35 U.S.C. 154(b) by 0 days.

(21) Appl. No.: 09/733,885

(22) Filed: Dec. 9, 2000

Related U.S. Application Data

(60) Provisional application No. 60/170,134, filed on Dec. 10, 1999.

(51) Int. Cl.[7] ..... F01L 7/00
(52) U.S. Cl. ..... 123/80 BA; 123/190.2
(58) Field of Search ..... 123/190.2, 80 R, 123/80 BA

(56) References Cited

U.S. PATENT DOCUMENTS

| | | | | |
|---|---|---|---|---|
| 1,094,329 A | | 4/1914 | Henderson | |
| 1,191,684 A | | 7/1916 | Fountain et al. | |
| 1,215,993 A | | 2/1917 | Rimbach | |
| 1,522,207 A | * | 1/1925 | Ronconi | 123/190.2 |
| 1,596,069 A | | 8/1926 | Skiles | |
| 1,794,061 A | * | 2/1931 | Culver | 123/190.2 |
| 2,401,932 A | | 6/1946 | Heintz | |
| 2,730,088 A | | 1/1956 | Hyde | |
| 3,628,518 A | | 12/1971 | Blair et al. | |
| 4,007,725 A | | 2/1977 | Weaver | |
| 4,016,840 A | | 4/1977 | Lockshaw | |
| 4,077,382 A | | 3/1978 | Gentile | |
| 4,098,514 A | | 7/1978 | Guenther | |
| 4,481,917 A | | 11/1984 | Rus et al. | |
| 4,494,500 A | | 1/1985 | Hansen | |
| 4,517,938 A | | 5/1985 | Kruger | |
| 4,545,337 A | | 10/1985 | Lyons et al. | |
| 4,751,900 A | | 6/1988 | Ruffolo | |
| 4,879,979 A | | 11/1989 | Triguero | |
| 4,949,685 A | | 8/1990 | Doland et al. | |
| 5,074,265 A | | 12/1991 | Ristin et al. | |
| 5,152,259 A | * | 10/1992 | Bell | 123/190.2 |
| 5,205,251 A | | 4/1993 | Conklin | |
| 5,249,553 A | | 10/1993 | Guiod | |
| 5,309,876 A | | 5/1994 | Schiattino | |
| 5,315,963 A | | 5/1994 | Warf | |
| 5,315,969 A | | 5/1994 | MacMillan | |
| 5,372,104 A | | 12/1994 | Griffin | |
| 5,392,743 A | | 2/1995 | Dokonal | |
| 5,448,971 A | | 9/1995 | Blundell et al. | |
| 5,526,780 A | | 6/1996 | Wallis | |
| 5,572,967 A | | 11/1996 | Donaldson, Jr. | |
| 5,690,069 A | | 11/1997 | Huwarts | |
| 5,706,775 A | | 1/1998 | Schweter et al. | |
| 5,711,265 A | | 1/1998 | Duve | |
| 5,724,926 A | | 3/1998 | Wilke | |
| 5,870,988 A | | 2/1999 | Fujimori et al. | |
| 5,906,180 A | | 5/1999 | Wilke | |
| 5,911,203 A | | 6/1999 | Lambert et al. | |
| 5,941,206 A | | 8/1999 | Smith et al. | |
| 5,967,108 A | | 10/1999 | Kutlucinar | |

* cited by examiner

*Primary Examiner*—Noah P. Kamen
(74) *Attorney, Agent, or Firm*—Kelly Bauersfeld Lowry & Kelley, LLP

(57) ABSTRACT

A rotary valve head system for a multi-cylinder engine includes hollow intake and exhaust rotary valve tubes having multiple apertures registerable with an engine intake or exhaust manifold according to a timing mechanism linked to the rotary valve tube. A cylinder head overlying the multiple cylinders includes head intake and exhaust ports registered with the cylinder intake and exhaust ports, which is configured such that a clearance is provided between the cylinder head and outer surfaces of the intake and exhaust rotary valve tubes. Inserts are positioned within the cylinder head to form a seal between the intake and exhaust rotary valve tube apertures and the cylinder head. Incoming air/fuel is permitted to flow through the intake rotary valve tube until entering into a cylinder through a tube aperture registered with a head intake port and cylinder intake port. Outgoing combustion products likewise flow through the exhaust tube.

23 Claims, 5 Drawing Sheets

ROTARY VALVE HEAD SYSTEM FOR MULTI-CYLINDER INTERNAL COMBUSTION ENGINES

RELATED APPLICATION

This application claims priority from provisional application Ser. No. 60/170,134, filed Dec. 10, 1999.

BACKGROUND OF THE INVENTION

The present invention generally relates to valve assemblies for internal combustion engines. More particularly, the present invention relates to a rotary valve system for multi-cylinder internal combustion engines which allows a cross-flow of gasses therethrough.

An operating cycle of an internal combustion engine, as is well known in the art, consists of four phases in the 4-stroke Otto cycle corresponding to respective piston strokes. These four stages comprise an intake phase for the aspiration of an explosive air/fuel mixture, a compression and ignition phase, an expansion or power phase, and an exhaust phase.

Internal combustion engines traditionally employ poppet type valves which require valve operating trains including valve springs, a camshaft, etc., in order to convert the rotary motion of the engine into the linear movement required by the poppet valves. These poppet valves are normally opened by movement mechanically inwardly of a cylinder in which they are placed by means of a rocker arm actuated by a push rod which in turn has been actuated by hydraulic lifters or the like driven from a camshaft in synchronism with the operation of the engine. Valve return has usually been by spring means. While a cam in head engine eliminates the push rods that are otherwise required, the cam mechanism does include levers and springs for maintaining the valves in a closed position.

Conventional poppet valves have various problems associated with them. A conventional poppet valve engine requires considerable power to overcome the resistance to opening the valves against cylinder pressure. The application of the necessary power to open the valves produces wear in the valve train. Further, the members of the valve train are reciprocating, resulting in power being dissipated while overcoming the inertia of the members in changing direction. Such valve structure also requires additional hood height and is inefficient at high speeds. Further, since the valves in the train are constantly exposed to the high temperature of the ignited fuel in the cylinders, burning of the valves at sustained high speed operation is possible.

Engines incorporating rotary valves have proven superior in certain respects in that they can be made with larger valve openings and are not limited by restrictions imposed by camshaft configurations, such as the necessary rise and fall times of the poppet valve operating cams. Also, such rotary valve engines are basically simpler in that they eliminate the need for valve operating trains.

The concept of a rotary valve in internal combustion engines has been present for many years. Although there is still high interest in rotary valves, no rotary valve engines have been incorporated into automobiles produced by the large automobile manufacturers. This is due, in part, to the fact that most of the previous designs were not able to be operably implemented into the engine. Some designs require entirely new engine and supporting system designs to accommodate the rotary valve system. Other designs have been found to be either impractical or excessively expensive.

Accordingly, there is a need for a rotary valve head system which can replace a traditional poppet type valve operating train without requiring significant alterations to the remainder of the engine. What is also needed is a rotary valve head system which is operable with standard engines while being cost effectively manufactured and implemented. The present invention fulfills these needs and provides other related advantages.

SUMMARY OF THE INVENTION

The present invention resides in a rotary valve head system for a multi-cylinder engine having pistons residing within multiple cylinders capable of reciprocal movement to form multiple combustion chambers. The system includes a hollow intake rotary valve tube having closed ends and multiple apertures corresponding to each cylinder intake port. Each aperture is registerable with an engine intake means, such as a conventional intake manifold, and a cylinder intake port according to an intake timing mechanism operably linked to the intake rotary valve tube. Similarly, a hollow exhaust rotary valve tube has closed ends and multiple apertures corresponding to each cylinder exhaust port. Each aperture is registerable with an engine exhaust means, such as a conventional exhaust manifold, and a cylinder exhaust port according to an exhaust timing mechanism operably linked to the exhaust rotary valve tube.

A cylinder head overlies the multiple cylinders and the intake and exhaust rotary valve tubes. The cylinder head has head intake ports registered with the cylinder intake ports of the multiple cylinders and registerable with the apertures of the intake rotary valve tube. Likewise, the head includes exhaust ports registered with the cylinder exhaust ports of the multiple cylinders and registerable with the apertures of the exhaust rotary valve tube.

The intake and exhaust rotary valve tubes may be generally cylindrical. At least one bushing overlies a portion of an outer surface of each of the intake and exhaust rotary valve tubes. Alternatively, the intake and exhaust rotary valve tubes includes spherical components having apertures aligned with the intake and exhaust rotary valve tube apertures. Bushings overlie the intake and exhaust rotary valve tubes between the spherical components.

The cylinder head is configured such that a clearance is provided between the cylinder head and outer surfaces of the intake and exhaust rotary valve tubes. A sleeve can be interposed between either the intake rotary valve tube or the exhaust rotary valve tube and the cylinder head. The sleeve has apertures aligned with the head intake or exhaust ports and cylinder intake or exhaust ports and registerable with the apertures of the intake or exhaust rotary valve tube. Sealing inserts are positioned within the cylinder head at the cylinder intake and exhaust ports. Means are provided for maintaining contact between the inserts and the intake and exhaust rotary valve tubes to form an air-tight seal between the intake and exhaust rotary valve tube apertures and the cylinder head.

Typically, a rod extends from an end of each of the intake and exhaust rotary valve tubes for connection to a bearing assembly secured to the cylinder head. The intake timing mechanism is operably linked to the rod extending from the intake rotary valve tube, and the exhaust timing mechanism is operably linked to the rod extending from the exhaust rotary valve tube.

Incoming air/fuel from the intake means is admitted within an aperture of the intake rotary valve tube and permitted to flow through the hollow intake rotary valve tube until entering into a cylinder through a tube aperture registered with a head intake port and cylinder intake port. The outgoing combustion products are emitted through an aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture which is registered with the exhaust passageway means.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
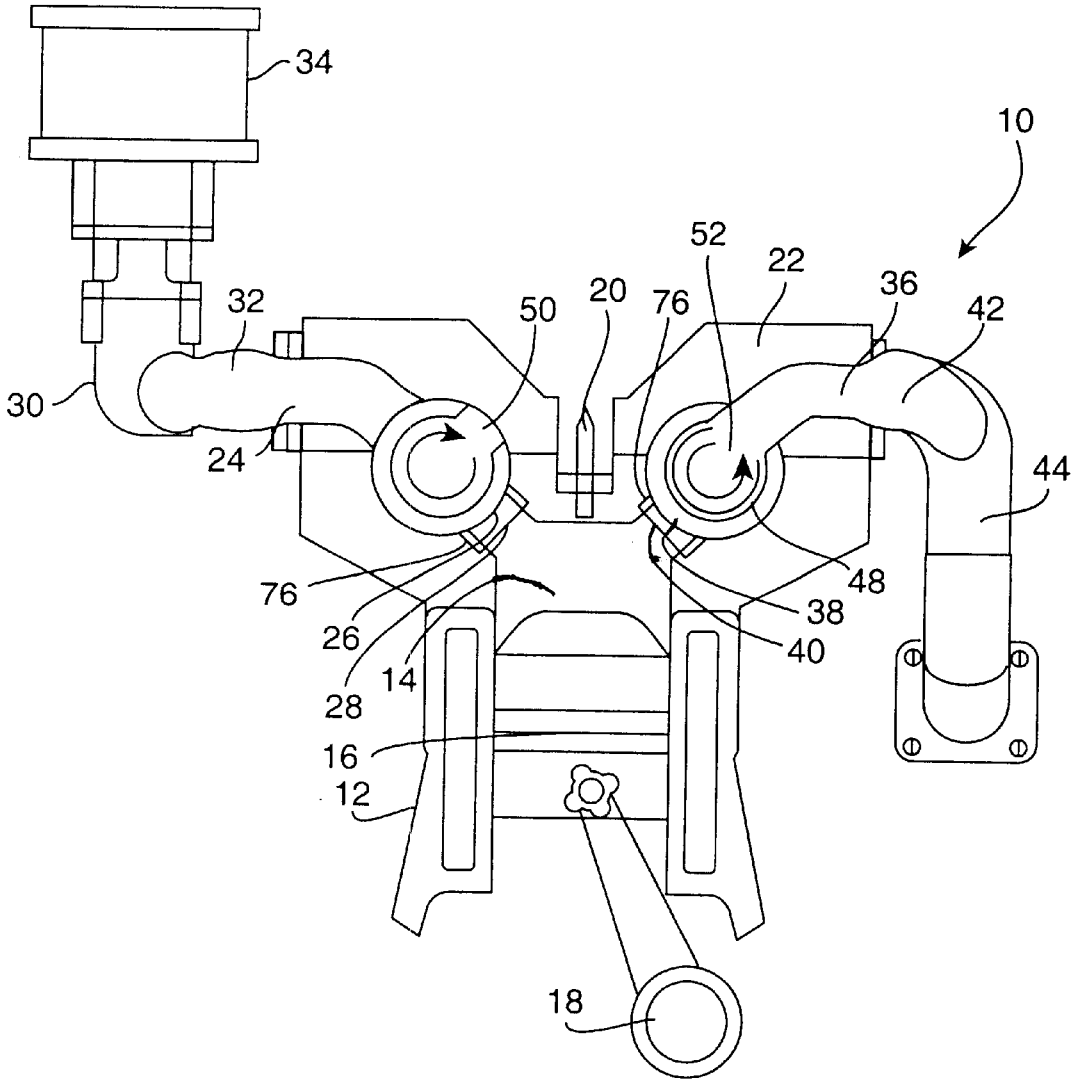
FIG. 1 is a partially cross-sectional view of an engine incorporating a rotary valve system embodying the present invention.

As shown in the drawings for purposes of illustration, the present invention is concerned with an internal combustion engine 10 having a cross-flow rotary valve system. In the drawings, the internal combustion engine 10 is illustrated as a four-cylinder gasoline engine, although the engine can have more or less cylinders and adapted to conventional carburetor or fuel injection on gasoline or diesel engines or any other internal combustion engine fuel-type, such as natural gas or hydrogen fuels.

With reference to FIG. 1, the engine 10 includes an engine block 12 forming multiple cylinder cavities 14 in which a piston 16 is positioned for operation. The piston 16 is connected to a crank shaft 18 and capable of reciprocal movement within the cylinder 14, and in conjunction with a spark plug 20 or the like forms a traditional combustion chamber. The engine 10 further includes a cylinder head 22 secured to the engine block 12 by machine screws or the like and includes threaded openings for receiving the spark plugs 20. The cylinder head 22 also includes head intake ports 24 and 26 which are aligned with cylinder intake ports 28 and intake manifold 30 outlets 32. A carburetor 34 or other fuel/air control device is connected to the intake manifold 30 and provides the necessary fuel/air mixture to the combustion chambers for operation of the engine 10. Likewise, the cylinder head 22 includes head exhaust ports 36 and 38 which are registered with cylinder exhaust ports 40 and outlets 42 of an exhaust manifold 44. The intake manifold 30 can be bolted directly to the intake side of the engine head and the exhaust manifold 44 can be bolted directly to the exhaust side of the engine cylinder head 22 similar to that of conventional poppet valve type cylinder engine heads.

The invention uses the standard engine head layout as much as possible in its rotary valve design implementation, with the cylinder head 22 configured to incorporate a dual tube rotary valve system in which one tube is employed as an intake 46 and the other tube as an exhaust 48. Apertures 50 and 52 are strategically placed around the circumference of each rotary valve tube 46 and 48 to correspond to engine ignition timing. For example, as the intake rotary valve tube 46 rotates, an aperture 50 thereof will become aligned with the intake manifold outlet 32 to draw an air/fuel mixture into the intake rotary valve tube 46 and further rotates until the aperture 50 is registered with a cylinder intake port 28 for emitting air/fuel mixture into a cylinder cavity 14. As will be described further herein, the intake and exhaust rotary valve tubes 46 and 48 are hollow and allow a cross-flow therethrough. The rotary valve tubes 46 and 48 are placed a distance apart to allow the use of either standard spark plugs 20 or fuel injectors (not shown) to be placed between them.

Figure 2:
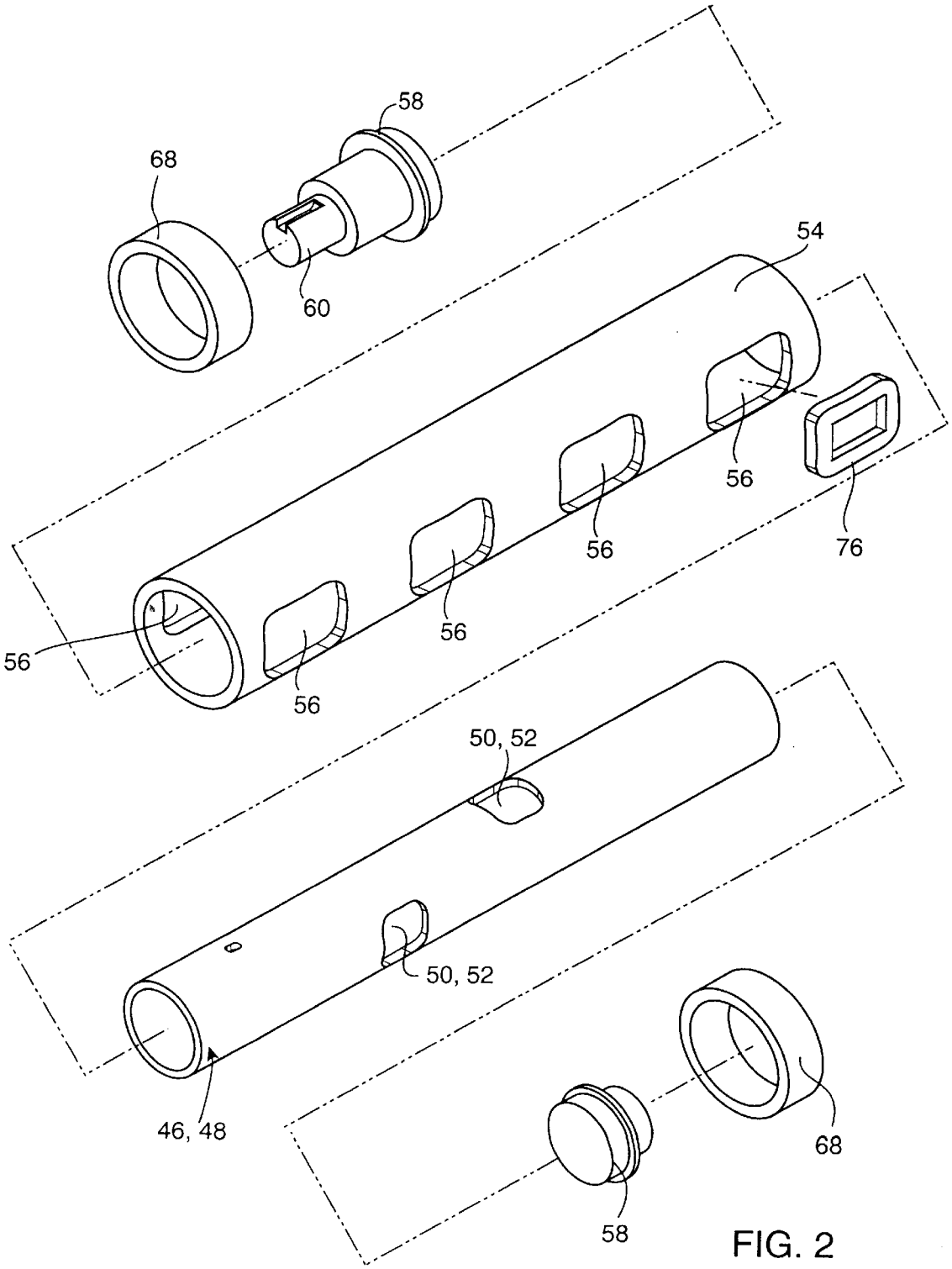
FIG. 2 is an exploded perspective view of a rotary valve tube assembly in accordance with the present invention.

Referring now to FIG. 2, a first embodiment of a rotary valve tube 46 or 48 in accordance with the present invention is illustrated. The hollow rotary valve tubes 46,48 are typically enclosed inside a hollow tube sleeve 54 having slots 56 which correspond to all of the engine cylinder head ports 24, 26 and 36, 38. The tube sleeve 54 is comprised of a thermally stable metal or composite alloy material. There is a very small clearance between the rotary valve tube 46, 48 and the inside of the sleeve tube 54 to avoid contact during operation. The rotary valve sleeve 54 can be omitted if the sleeve function of maintain a small clearance with the rotary valve tubes 46, 48 can be duplicated within the cylinder head enclosure 22.

Each rotary valve tube 46,48 is sealed at both ends with plugs 58. A rod 60 extends from one of the plugs 58 for mounting high speed thrust bearings 62 and timing belt gears 64 to allow rotation from the engine crank shaft 18 utilizing a timing mechanism, such as the timing belt 66 illustrated in FIGS. 6 and 7. The attached drawings illustrate the use of a timing belt type setup. However, it is to be understood that the system can be adapted to work with either external or internal timing chains as well. The plugs 58 and rods 60 are comprised from thermally stable strong metal or composite alloy material.

The rotary valve tubes 46, 48 use high temperature and high speed wear resistant bushings 68 and/or bearings with similar radial bearings overlying a portion of the outer surface of each of the intake and exhaust rotary valve tubes 46, 48. The cylinder head 22 is preferably configured such that a clearance is provided between the cylinder head and outer surfaces of the intake and exhaust rotary valve tubes 46, 48 so that only the bushings or bearings 68 are in contact with the cylinder head 22. All methods of engine head cooling and lubrication can be adapted for each possible application. The bearings and high-speed bushings 68 can be use wet or dry lubrications methods as needed, and well known in the prior art, depending upon individual applications.

Figure 3:
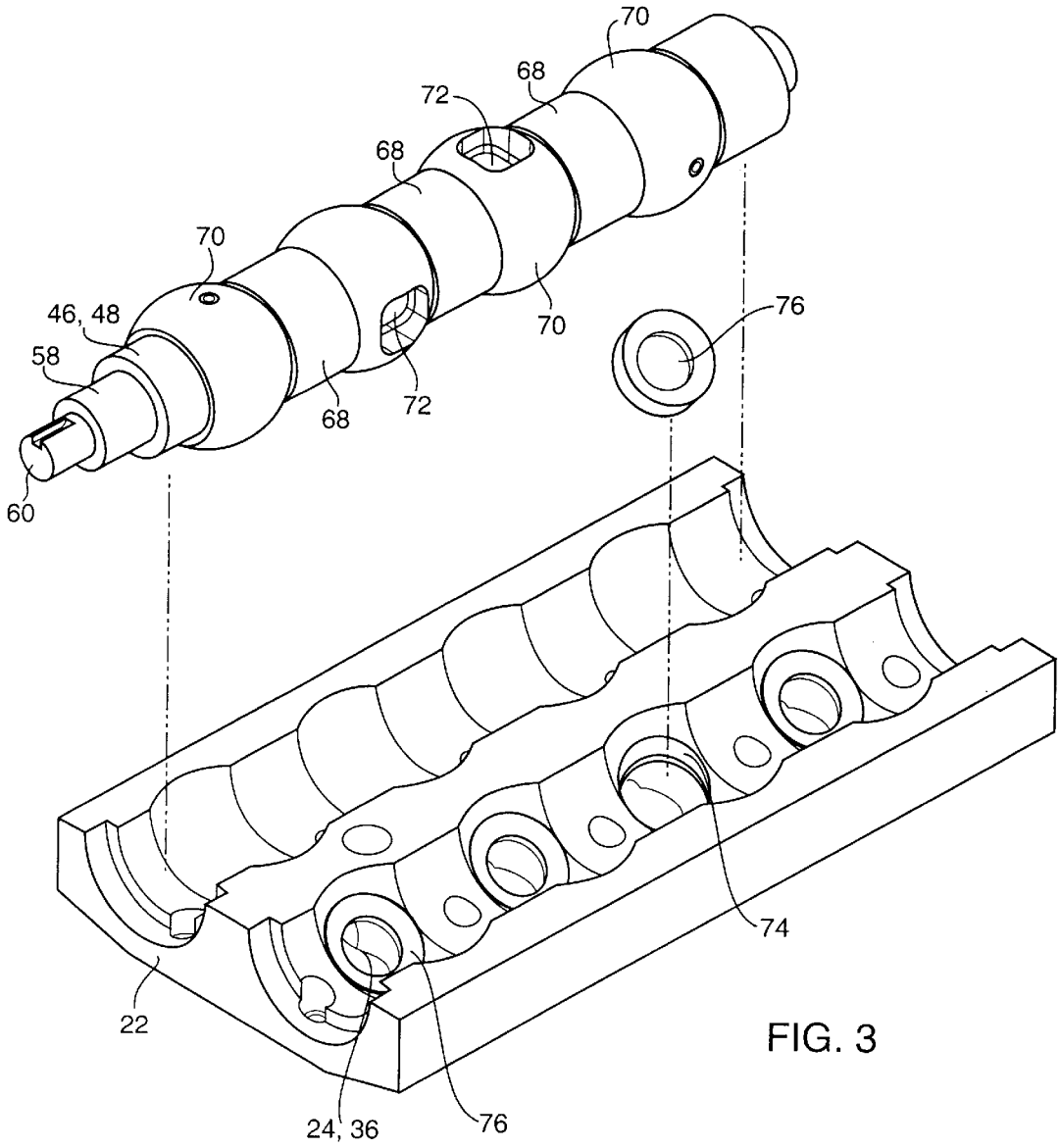
FIG. 3 is a partially exploded view of another form of rotary valve assembly embodying the present invention, and sealing inserts positioned within a head cylinder.

With reference to FIG. 3, another embodiment is illustrated wherein the rotary valve tube 46, 48 incorporates spherical components 70 overlying each aperture 50, 52 of the rotary valve tube 46, 48. The spherical components 70 each have an aperture 72 which is aligned with the corresponding rotary valve tube aperture. In a particularly preferred embodiment, bushings 68 are interposed between the spherical components 70. The rotary valve tubes 46, 48 are closed at the ends thereof by the plugs 58 as described above. FIG. 3 illustrates the configuration of the cylinder head 22 to accommodate the rotary valve tube 46, 48. As stated above, the cylinder head 22 includes head intake and exhaust ports 26 and 38. These ports 26 and 38 may have a seat 74 formed therein for the placement of an insert 76 which contacts either the rotary valve tube 46, 48 itself or the spherical component 70 to form an air-tight seal between the port 26, 38 and the rotary valve tube 46, 48 or spherical component 70. The inserts are comprised of a high temperature and wear resistant material. The rotary valve tubing 46, 48 or spherical component 70 is comprised of an extremely hard, close tolerance, ground and polished surface made of a thermally stable and strong metal or composite alloy material. Similarly, the inserts 76 are comprised of a close tolerance, thermally stable, high strength/low friction and wear resistant ceramic or composite alloy material.

In the preferred embodiment, the rotary valve tube 46, 48 or spherical component 70 maintains physical contact with the insert 76 only. Means are provided for placing the insert 76 in constant contact with the rotary valve tube 46, 48. Such means can include spring loading the insert 76, or providing a pneumatic channeling means to maintain an airtight seal. Although a preferred embodiment having a generally cylindrical rotary valve tube 46, 48 having spherical components 70 overlying apertures 50, 52 of the tubes 46, 48 is illustrated and described, it is to be understood that the shape and design of the rotary valve tubes 46, 48 can be altered and still conform to the concepts of the present invention.

Figure 4:
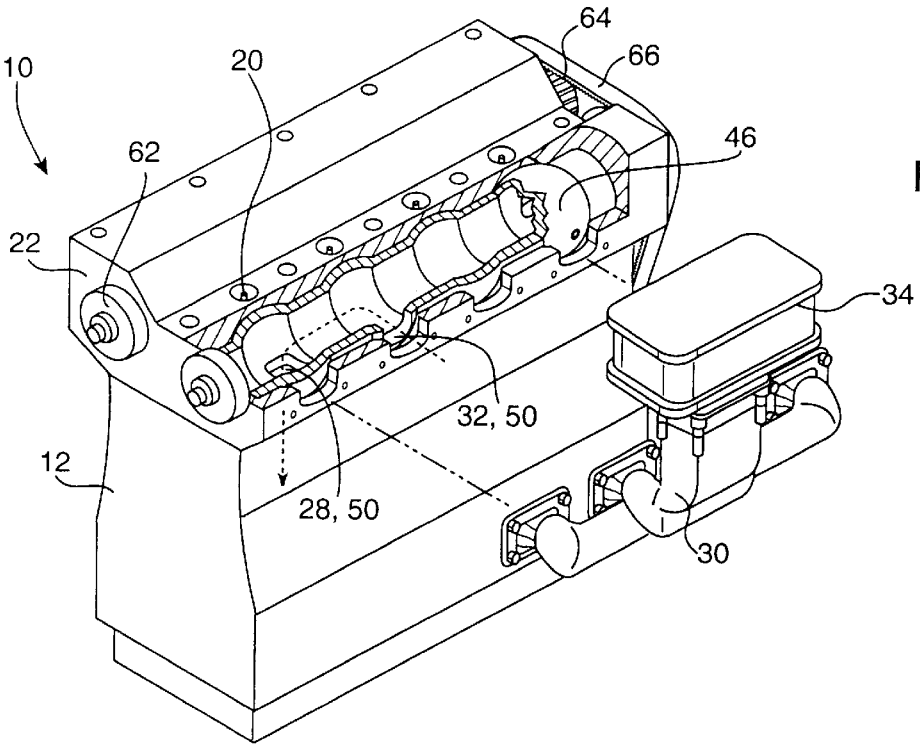
FIG. 4 is a partially fragmented, cross-sectional view of an engine illustrating the intake of an air/fuel mixture into a first cylinder thereof.

The operation of the invention is illustrated in FIGS. 4–7. A primary object of the invention is to make any one aperture 50, 52 on the rotary valve tube 46, 48 to have double duty as both an inlet and outlet, producing a cross-flow of gasses within the hollow rotary valve tube 46, 48 during its operation. With reference to FIG. 4, during rotation of the intake rotary valve tube assembly 46, each aperture 50 on the tube 46 will pass over the cylinder head intake ports 24 and 26. When the aperture 50 is facing and registered with the intake manifold outlet 32, gasses are allowed to freely flow into the rotary valve tube 46 and into a cylinder cavity 14 through an aligned aperture 50 and cylinder intake port 28. It will be noted that only one aperture 50 of the rotary valve tube 46 will be aligned with a cylinder 14 while another aperture 50 of the intake rotary valve tube 46 will be aligned with the intake manifold 30 at any given time.

Figure 6:
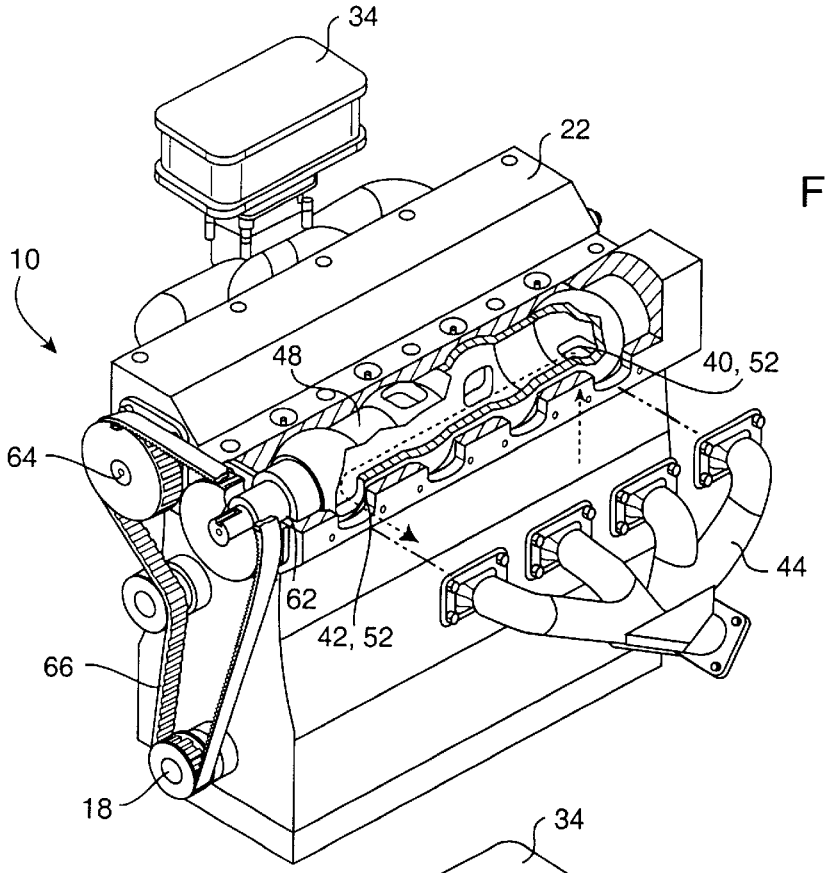
FIG. 6 is a partially exploded and fragmented view of an engine incorporating the present invention, illustrating the emission of combusted products from a first cylinder thereof.

With reference to FIGS. 4 and 6, the general operating procedure of the cross-flow rotary valve system is demonstrated. During the suction cycle of the first cylinder of a multi-cylinder engine 10, the intake rotary valve tube 46 rotates and aligns the corresponding rotary valve tube aperture 50 with the corresponding cylinder intake port 28. This produces a pathway for the air/fuel mixture to flow from the rotary valve tube inner cavity and into the first cylinder's combustion chamber. Simultaneously, another aperture 50 on the same intake rotary valve tube 46 is aligned with its corresponding intake manifold outlet port 32. This produces a pathway for the air/fuel mixture to flow from the intake manifold 30 into the rotary valve tube 46. The air/fuel mixture will flow from the intake manifold 30, through the intake manifold outlet 32 and the aligned intake rotary valve tube aperture 50 and proceed through the intake rotary valve tube 46 and into the combustion chamber of the engine cylinder 14 that is in the suction cycle through the corresponding aligned intake rotary valve tube aperture 50 and cylinder intake port 28. This process will continue until the piston 16 reaches is full down stroke position. This will coincide with the closing of the combustion chamber intake port 28 as the intake rotary valve tube aperture 50 rotates out of alignment, sealing the combustion chamber from the intake side. As the piston 16 proceeds upward during compression, then downwards during the power cycle, the intake rotary valve tube aperture 50 rotates away, sealing the intake combustion chamber port 28 of the corresponding combustion chamber.

With reference to FIG. 6, during the exhaust cycle of the same cylinder 14, the piston 16 proceeds upwards, the exhaust rotary valve tube 48 has rotated and aligned a corresponding exhaust rotary valve tube aperture 52 with the corresponding combustion chamber exhaust port 40. This produces a pathway for the air and combustable products to flow from the combustion chamber and into the exhaust rotary valve tube 48. Simultaneously, another aperture 52 on the same exhaust rotary valve tube 48 is aligned with its corresponding exhaust manifold outlet port 42. This produces a pathway for the air combustable products to flow from the rotary valve tube cavity 48 into the exhaust manifold 44. The exhaust gases will flow from the combustion chamber of the cylinder 14, through the combustion chamber exhaust port 40, passing through the aperture 52 of the exhaust rotary valve tube 48 open to the combustion chamber exhaust port 40 and into the rotary valve tube 48, and proceed through the exhaust rotary valve tube 48 through the aligned aperture 52 and outlet 42 and through the exhaust manifold 44 so as to leave the system.

Figure 5:
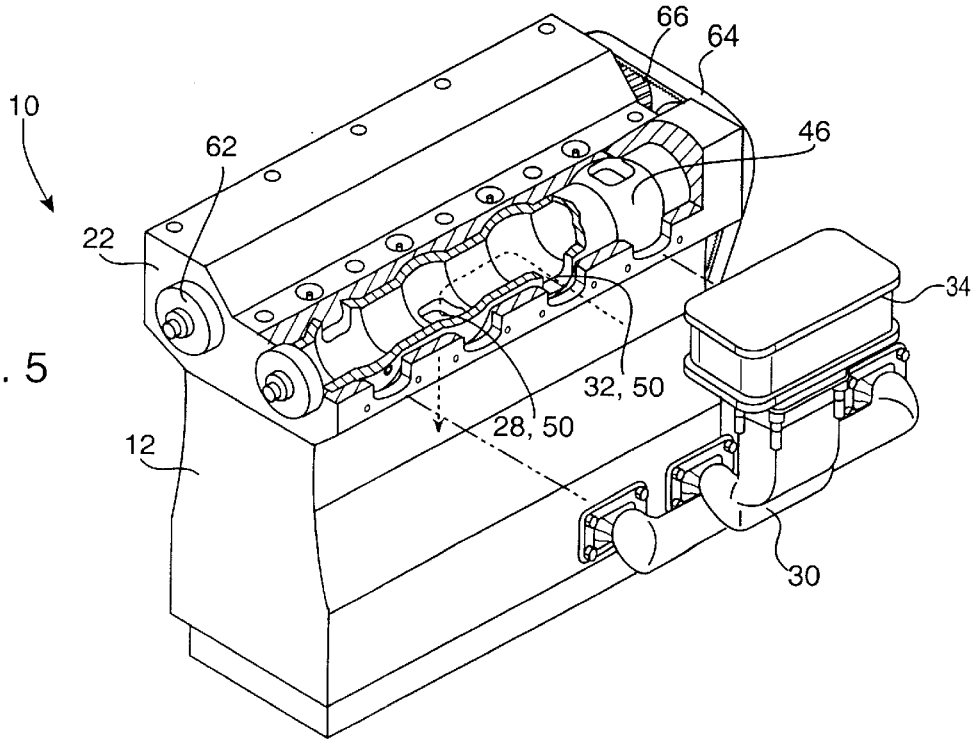
FIG. 5 is a partially exploded and fragmented view of the engine of FIG. 4, illustrating the intake of an air/fuel mixture into a second cylinder thereof.
Figure 7:
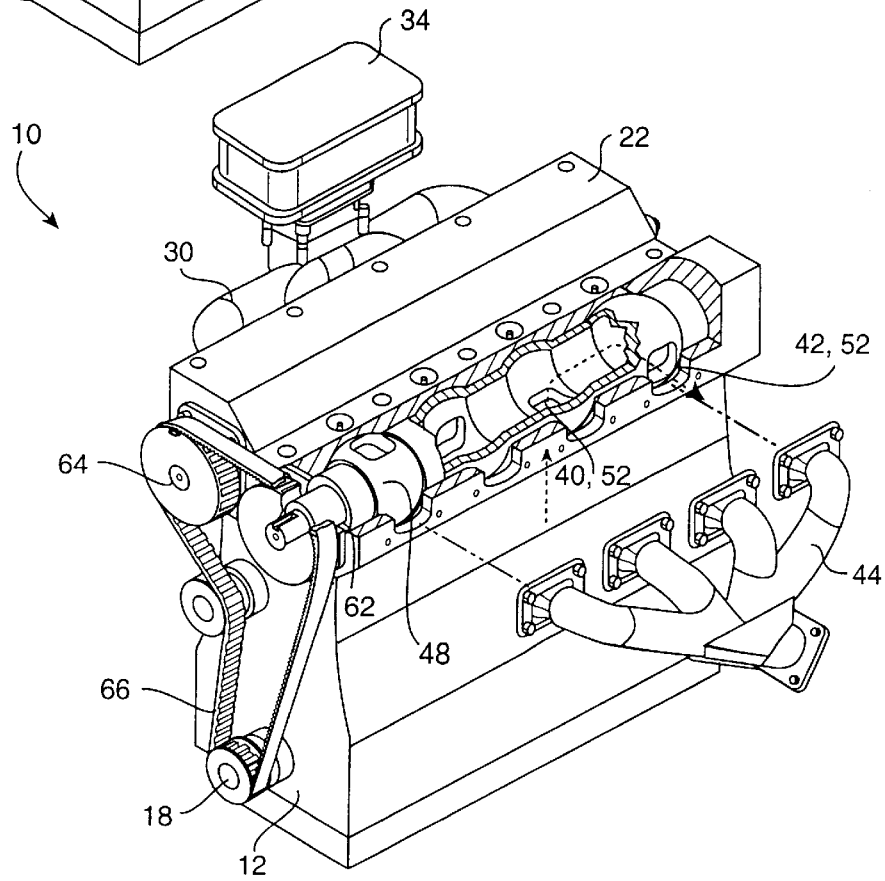
FIG. 7 is a partially exploded and fragmented view of an engine similar to FIG. 6, wherein combusted particles are emitted from a second cylinder of the engine.

FIGS. 5 and 7 illustrate the same process of the intake of air/fuel mixture and the emission of exhaust particles from another cylinder 14 of the engine 10. FIGS. 4–7 use the example of a set-up for a 4-cylinder engine with a firing order of 1-2-3-4. Of course, this can be modified by changing the firing order to allow gases to exhaust to an adjacent exhaust port. The same can be said for the intake characteristics of the engine 10. The same concept can be applied to other engines, such as straight line, V-type, horizontally opposed, rotary, or any engine that currently uses poppet type valve systems.

It will be appreciated that the cross-flow rotary valve system of the present invention can replace existing overhead cam engine heads directly without major modifications. Use of the rotary valve system permits higher engine speeds beyond 7,000 to 10,000 RPM due to the elimination of valve floats exhibited by the poppet valve type engines. The invention, by eliminating the reciprocating action, also eliminates many components such as the push rod, rocker arm, cam shaft, hydraulic lifters, etc. associated with valve type poppet valve type systems.

Although several embodiments have been described in detail for purposes of illustration, various modifications may be made without departing from the scope and spirit of the invention. Accordingly, the invention is not to be limited, except as by the appended claims.

I claim:

1. A rotary valve head system for a multi-cylinder engine having pistons residing within cylinders and capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube; and a cylinder head overlying the multiple cylinders and the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube;

wherein incoming fuel/air from the intake means is admitted within an aperture of the intake rotary valve tube and permitted to flow through the hollow intake rotary valve tube until entering into a cylinder through a tube aperture registered with a head intake port and a cylinder intake port;

wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith; and wherein the intake and exhaust rotary valve tubes include spherical components having apertures aligned with the intake and exhaust rotary valve tube apertures.

2. The system of claim 1, wherein the intake and exhaust rotary valve tubes are generally cylindrical.

3. The system of claim 1, wherein the intake and exhaust rotary valve tubes include spherical components having apertures aligned with the intake and exhaust rotary valve tube apertures.

4. The system of claim 1, including bushings overlying the intake and exhaust rotary valve tubes between the spherical components.

5. The system of claim 1, wherein the cylinder head is configured such that a clearance is provided between the cylinder head and outer surfaces of the intake and exhaust rotary valve tubes.

6. The system of claim 1, including at least one bushing overlying a portion of the outer surface of each of the intake and exhaust rotary valve tubes.

7. The system of claim 5, including a sleeve interposed between the intake rotary valve tube and the cylinder head, the sleeve having apertures aligned with the head intake ports and cylinder intake ports and registerable with the apertures of the intake rotary valve tube.

8. The system of claim 5, including a sleeve interposed between the exhaust rotary valve tube and the cylinder head, the sleeve having apertures aligned with the head exhaust ports and cylinder exhaust ports and registerable with the apertures of the exhaust rotary valve tube.

9. The system of claim 1, including inserts within the cylinder head at the cylinder intake and exhaust ports, and means for maintaining contact between the inserts and the intake and exhaust rotary valve tubes to form a seal between the intake and exhaust rotary valve tube apertures and the cylinder head.

10. The system of claim 1, including a rod extending from an end of each of the intake and exhaust rotary valve tubes for connecting to a bearing assembly secured to the cylinder head.

11. The system of claim 10, wherein the intake timing mechanism is operably linked to the rod extending from the intake rotary valve tube and the exhaust timing mechanism is operably linked to the rod extending from the exhaust rotary valve tube.

12. A rotary valve head system for a multi-cylinder engine having multiple cylinders and pistons capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to a rod extending from a closed end of the intake rotary valve tube;

at least one bushing overlying at least a portion of an outer surface of the intake rotary valve tube;

a bearing assembly connected to each closed end of the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube; and at least one bushing overlying at least a portion of an outer surface of the exhaust rotary valve tube;

a bearing assembly connected to each closed end of the exhaust rotary valve tube;

a cylinder head overlying the multiple cylinders and the intake and exhaust rotary valve tubes such that a clearance is provided between the cylinder head and outer surfaces of the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube;

inserts within the cylinder head at the intake and exhaust ports of the cylinder head; and means for placing the inserts into contact with the intake and exhaust rotary valve tubes during operation;

wherein incoming fuel/air from the intake means is admitted within an aperture of the intake rotary valve tube and permitted to flow through the hollow intake rotary valve tube until entering into a cylinder through a tube aperture registered with a head intake port and cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith.

13. The system of claim 12, wherein the intake and exhaust rotary valve tubes are generally cylindrical.

14. The system of claim 12, wherein the intake and exhaust rotary valve tubes include spherical components overlying the intake and exhaust rotary valve tube, the spherical components having apertures aligned with the intake and exhaust valve tube apertures.

15. The system of claim 14, including bushings overlying the intake and exhaust rotary valve tubes between the spherical components.

16. The system of claim 12, including a sleeve interposed between the intake rotary valve tube and the cylinder head, the sleeve having apertures aligned with the head intake ports and cylinder intake ports and registerable with the apertures of the intake rotary valve tube, and a sleeve interposed between the exhaust rotary valve tube and the cylinder head, the sleeve having apertures aligned with the head exhaust ports and cylinder exhaust ports and registerable with the apertures of the exhaust rotary valve tube.

17. A rotary valve head system for a multi-cylinder engine having multiple cylinders and pistons capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a generally cylindrical hollow intake rotary valve tube having closed ends and multiple apertures formed therethrough corresponding to each cylinder intake port, wherein each aperture is registerable with the engine intake means and a cylinder intake port according to an intake timing mechanism operably linked to a rod extending from a closed end of the intake rotary valve tube;

spherical components overlying an outer surface of the intake rotary valve tube and having apertures aligned with the apertures of the intake rotary valve tube;

bushings overlying the outer surface of the intake rotary valve tube and positioned between the spherical components;

a bearing assembly connected to each closed end of the intake rotary valve tube;

a generally cylindrical hollow exhaust rotary valve tube having closed ends and multiple apertures formed therethrough corresponding to each cylinder exhaust port, wherein each aperture is registerable with the engine exhaust means and a cylinder exhaust port according to an exhaust timing mechanism operably linked to a rod extending from a closed end of the exhaust rotary valve tube;

spherical components overlying an outer surface of the exhaust rotary valve tube and having apertures aligned with the apertures of the exhaust rotary valve tube;

bushings overlying the outer surface of the exhaust rotary valve tube and positioned between the spherical components;

a bearing assembly connected to each closed end of the exhaust rotary valve tube;

a cylinder head overlying the multiple cylinders and the intake and exhaust rotary valve tubes such that a clearance is provided between the cylinder head and outer surfaces of the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube;

inserts within the cylinder head at the intake exhaust ports of the cylinder head; and means for placing the inserts into contact with the intake and exhaust rotary valve tubes during operation;

wherein incoming fuel/air from the intake means is admitted within an aperture of the intake rotary valve tube and permitted to flow through the hollow intake rotary valve tube until entering into a cylinder through a tube aperture registered with a head intake port and cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passageway means through an exhaust rotary valve tube aperture registered therewith.

18. The system of claim 17, including a sleeve interposed between the intake rotary valve tube and the cylinder head, the sleeve having apertures aligned with the head intake ports and cylinder intake ports and registerable with the apertures of the intake rotary valve tube, and a sleeve interposed between the exhaust rotary valve tube and the cylinder head, the sleeve having apertures aligned with the head exhaust ports and cylinder exhaust ports and registerable with the apertures of the exhaust rotary valve tube.

19. A rotary valve head system for a multi-cylinder engine having pistons residing within cylinders and capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube;

a cylinder head overlying the multiple cylinders and the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube, wherein the cylinder head is configured such that a clearance is provided between the cylinder head and outer surfaces of the intake and exhaust rotary valve tubes; and a sleeve interposed between the intake rotary valve tube and the cylinder head, the sleeve having apertures aligned with the head intake ports and cylinder intake ports and registerable with the apertures of the intake rotary valve tube;

wherein incoming fuel/air from the intake means is admitted within an aperture of the intake rotary valve tube and permitted to flow through the hollow intake rotary valve tube until entering into a cylinder through a tube aperture registered with a head intake port and a cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith.

20. A rotary valve head system for a multi-cylinder engine having pistons residing within cylinders and capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube;

a cylinder head overlying the multiple cylinders and the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube, wherein the cylinder head is configured such that a clearance is provided between the cylinder head and outer surfaces of the intake and exhaust rotary valve tubes; and a sleeve interposed between the exhaust rotary valve tube and the cylinder head, the sleeve having apertures aligned with the head exhaust ports and cylinder exhaust ports and registerable with the apertures of the exhaust rotary valve tube;

wherein incoming fuel/air from the intake means is admitted within an aperture of the intake rotary valve tube and permitted to flow through the hollow intake rotary valve tube until entering into a cylinder through a tube aperture registered with a head intake port and a cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith.

21. A rotary valve head system for a multi-cylinder engine having pistons residing within cylinders and capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube;

a cylinder head overlying the multiple cylinders and the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube; and inserts within the cylinder head at the cylinder intake and exhaust ports, and means for maintaining contact between the inserts and the intake and exhaust rotary valve tubes to form a seal between the intake and exhaust rotary valve tube apertures and the cylinder head;

wherein incoming fuel/air from the intake means is admitted within an aperture of the intake rotary valve tube and permitted to flow through the hollow intake rotary valve tube until entering into a cylinder through a tube aperture registered with a head intake port and a cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith.

22. A rotary valve head system for a multi-cylinder engine having pistons residing within cylinders and capable of reciprocal movement therein forming multiple combustion chambers, each cylinder having intake and exhaust ports, the engine having fuel, air or fuel/air intake means to each cylinder and exhaust passage means for exhausting combustion products from each cylinder, the rotary valve head system comprising:

a hollow intake rotary valve tube having closed ends and multiple apertures formed therethrough corresponding to each cylinder intake port, wherein each aperture is registerable with the engine intake means and a cylinder intake port according to an intake timing mechanism operably linked to the intake rotary valve tube;

a hollow exhaust rotary valve tube having closed ends and multiple apertures formed therethrough corresponding to each cylinder exhaust port wherein each aperture is registerable with the engine exhaust passageway means and a cylinder exhaust port according to an exhaust timing mechanism operably linked to the exhaust rotary valve tube;

a cylinder head overlying the multiple cylinders and the intake and exhaust rotary valve tubes, the cylinder head having head intake ports registered with the cylinder intake ports of the multiple cylinders and registerable with the apertures of the intake rotary valve tube, and head exhaust ports registered with the cylinder exhaust ports of the multiple cylinders and registerable with the apertures of the exhaust rotary valve tube; and a rod extending from an end of each of the intake and exhaust rotary valve tubes for connecting to a bearing assembly secured to the cylinder head;

wherein incoming fuel/air from the intake means is admitted within an aperture of the intake rotary valve tube and permitted to flow through the hollow intake rotary valve tube until entering into a cylinder through a tube aperture registered with a head intake port and a cylinder intake port; and wherein the outgoing combustion products are emitted through the aligned cylinder exhaust port, head exhaust port, and an aperture of the exhaust rotary valve tube and permitted to flow through the hollow exhaust rotary valve tube until exiting into the exhaust passage means through an exhaust rotary valve tube aperture registered therewith.

23. The system of claim 22, wherein the intake timing mechanism is operably linked to the rod extending from the intake rotary valve tube and the exhaust timing mechanism is operably linked to the rod extending from the exhaust rotary valve tube.

* * * * *